US008164240B2

(12) United States Patent
Auer et al.

(10) Patent No.: US 8,164,240 B2
(45) Date of Patent: Apr. 24, 2012

(54) ANTI-DAZZLE DEVICE WITH A FILAMENT

(75) Inventors: Frank Auer, Herbrechtingen-Bolheim (DE); Gerhard Behr, Altheim (DE); Peter Helbig, Sontheim/Brenz (DE); Christian Seichter, Herbrechtingen (DE); Klaus Wittmann, Sontheim (DE); Sascha Zelt, Beimerstetten (DE)

(73) Assignee: Osram AG, Munich (DE)

( * ) Notice: Subject to any disclaimer, the term of this patent is extended or adjusted under 35 U.S.C. 154(b) by 83 days.

(21) Appl. No.: 12/448,282

(22) PCT Filed: Dec. 5, 2007

(86) PCT No.: PCT/EP2007/063374

§ 371 (c)(1),
(2), (4) Date: Oct. 28, 2009

(87) PCT Pub. No.: WO2008/074640

PCT Pub. Date: Jun. 26, 2008

(65) Prior Publication Data

US 2010/0090578 A1 Apr. 15, 2010

(30) Foreign Application Priority Data

Dec. 19, 2006 (DE) ..... 10 2006 060 029

(51) Int. Cl.
*H01K 1/26* (2006.01)

(52) U.S. Cl. ..... 313/115; 313/578

(58) Field of Classification Search ..... 313/115, 313/379, 578–579; 262/211–214
See application file for complete search history.

(56) References Cited

U.S. PATENT DOCUMENTS

| | | | | |
|---|---|---|---|---|
| 3,646,385 | A | | 2/1972 | Wichert |
| 4,772,987 | A | * | 9/1988 | Kretschmer et al. ..... 362/539 |
| 5,984,751 | A | | 11/1999 | Rittner |
| 2006/0091775 | A1 | | 5/2006 | Auer et al. |

FOREIGN PATENT DOCUMENTS

| | | | |
|---|---|---|---|
| DE | 1 901 179 | A1 | 1/1969 |
| DE | 196 24 688 | A1 | 6/1996 |
| DE | 197 07 245 | A1 | 2/1997 |
| DE | 10 2004 053 644 | A1 | 3/2004 |
| WO | WO 98/38670 | A1 | 9/1998 |

* cited by examiner

*Primary Examiner* — Karabi Guharay
*Assistant Examiner* — Elmito Breval
(74) *Attorney, Agent, or Firm* — Holtz, Holtz, Goodman & Chick, PC

(57) ABSTRACT

The invention relates to a dipping cap comprising a filament for a dual-filament lamp. The dimension between an outlet of an outgoing section of the filament, on the side of the base, and the point on the outgoing section of the filament, arranged opposite the outgoing section of the filament on the side of the base and welded to the dipping cap, measures more than approximately 5.2 mm and less than 9.7 mm, and the dimension between the outlet of the outgoing section of the filament, on the side of the base, and the front surface of the dipping cap, which is adjacent to the outgoing section of the filament, welded to the dipping cap, measures more than approximately 5.9 mm and less than 11.9 mm.

10 Claims, 3 Drawing Sheets

ANTI-DAZZLE DEVICE WITH A FILAMENT

This application is a U.S. National Phase Application under 35 USC 371 of International Application PCT/EP2007/063374, filed Dec. 5, 2007, which is incorporated herein in its entirety by this reference.

TECHNICAL FIELD

The invention is based on an anti-dazzle device with a filament for two-filament lamps which are used in particular in vehicle headlamps.

PRIOR ART

A two-filament halogen incandescent lamp which has a lamp bulb which has a tight pinch seal at one end, which pinch seal is fixed in clamping fashion in a holder part made from stainless steel, is known from the publication WO 98/38670. Two incandescent filaments, which can be connected to a lamp base overall via three fused-in power supply lines or via molybdenum foils and power supply lines connected thereto, are located within the lamp bulb.

The incandescent filament 1 of this halogen incandescent lamp, which incandescent filament is shown in FIG. 1 and is provided adjacent to the lamp cover, is provided with an anti-dazzle device 2, which has a welding lug 6 provided with a transverse rib 4. An outgoing filament end 8 extends from the incandescent filament 2 to the welding point 10 at which the outgoing filament end 8 can be welded to the transverse rib 4 by means of projection welding.

The distance between a point at which a base-side outgoing filament end (not shown in FIG. 1) emerges from the filament 2 and the welding point 10 has the dimension A of 9.7 mm, while the distance between the point at which the base-side outgoing filament end emerges from the filament 2 and the end face of the welding lug 6 has the dimension B of 11.9 mm.

The anti-dazzle device shown in FIG. 1, which is in particular used in H4 lamps, is responsible for the light/dark boundary. The anti-dazzle device 2 is produced from sheet molybdenum.

DESCRIPTION OF THE INVENTION

The object of the present invention is to provide an anti-dazzle device with a filament for a two-filament lamp, in which it is possible to achieve a reduction in costs, precise determination of the filament position and low transmission losses.

This object is achieved by an anti-dazzle device with a filament as claimed in claim 1.

Particularly advantageous configurations are given in the dependent claims.

The invention provides an anti-dazzle device with a filament for a two-filament lamp, the dimension between a point at which a base-side outgoing filament end emerges from the filament and the point on the outgoing filament end which is arranged opposite the base-side, outgoing filament end and is welded to the anti-dazzle device being between approximately 5.2 mm and less than 9.7 mm, and the dimension between the point at which the base-side outgoing filament end emerges from the filament and the end face of the anti-dazzle device, which is adjacent to the outgoing filament end, at which the outgoing filament end is welded to the anti-dazzle device, being between approximately 5.9 mm and less than 11.9 mm. An anti-dazzle device which is optimized in terms of costs and quality can therefore be used, in particular when the anti-dazzle devices are not responsible for the light/dark boundary in vehicle headlamps.

It is preferred that the anti-dazzle device is connected to the outgoing filament end by means of projection welding. It is thus possible to use a reliable joint between the parts to be welded without any additional material and therefore without additional material being introduced.

It is preferred if the welding projection on the anti-dazzle device for the projection welding has, in cross section, the form of a ring segment, preferably with an angle of 90°. The welding lug of the anti-dazzle device can therefore be modified in a simple manner by introducing a transverse rib and it is possible for outgoing filament ends to be attached with any desired relative position in relation to the transverse rib.

In a preferred embodiment, a planar face of the anti-dazzle device is connected to the outgoing filament end. In this way, the outgoing filament end can extend parallel to the longitudinal axis of the filament and a uniform distance between the filament and the bottom of the anti-dazzle device can be used.

In a development according to the invention, the anti-dazzle device with a filament is designed for a halogen incandescent lamp for a vehicle headlamp, with the result that the use in daytime running lights is possible, for example.

In addition, it is preferred if the two-filament lamp is a two-filament headlamp since in this way it is possible to realize a lower beam and an upper beam or an upper beam and a daytime running light in one lamp.

In addition it is preferred if the two-filament lamp is a two-filament halogen lamp since, in this way, it is possible to produce a particular luminous intensity with excellent light quality.

In one development, a headlamp with a lamp is provided which has an anti-dazzle device with a filament, wherein a shield is responsible for the light/dark boundary outside of the lamp vessel of the two-filament lamp and in the space delimited by the reflector. This takes into account the circumstance in which the preferred tolerances for the assembly comprising the anti-dazzle device and the filament in lamps can be used particularly well when the light/dark boundary is realized by a mechanically actuated shield in the interior of the vehicle headlamp. As a result, the daytime running light and the upper beam can be produced by the two filaments of the lamp, while the lower beam is produced by means of the shield.

BRIEF DESCRIPTION OF THE DRAWINGS

The invention will be explained in more detail below with reference to three exemplary embodiments. In the figures.

PREFERRED EMBODIMENT OF THE INVENTION

Figure 1:
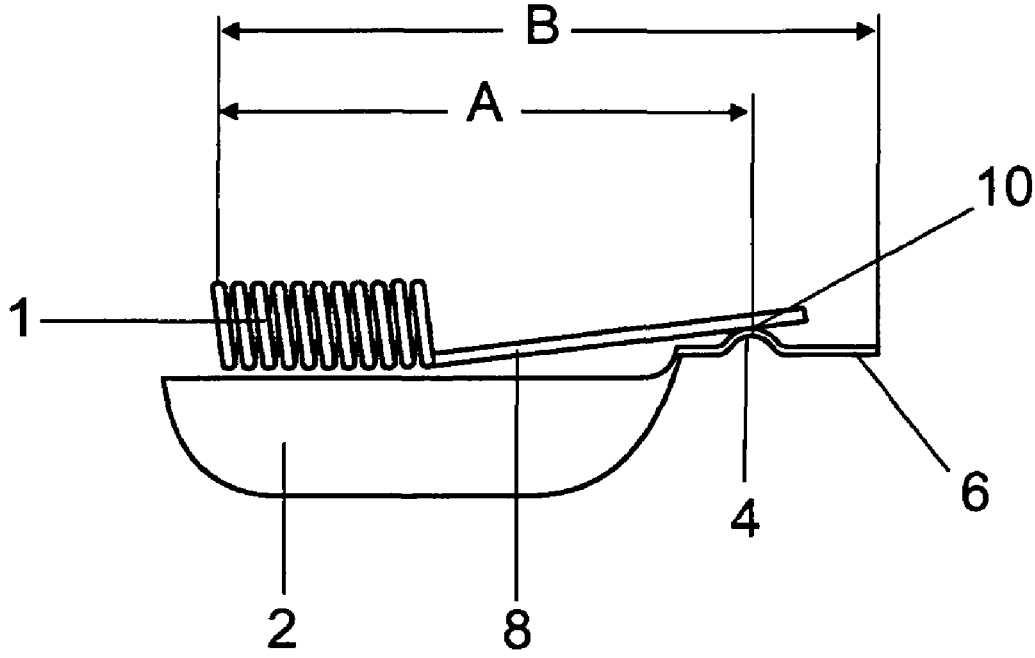
FIG. 1 shows an anti-dazzle device with a filament in accordance with the prior art.
Figure 2:
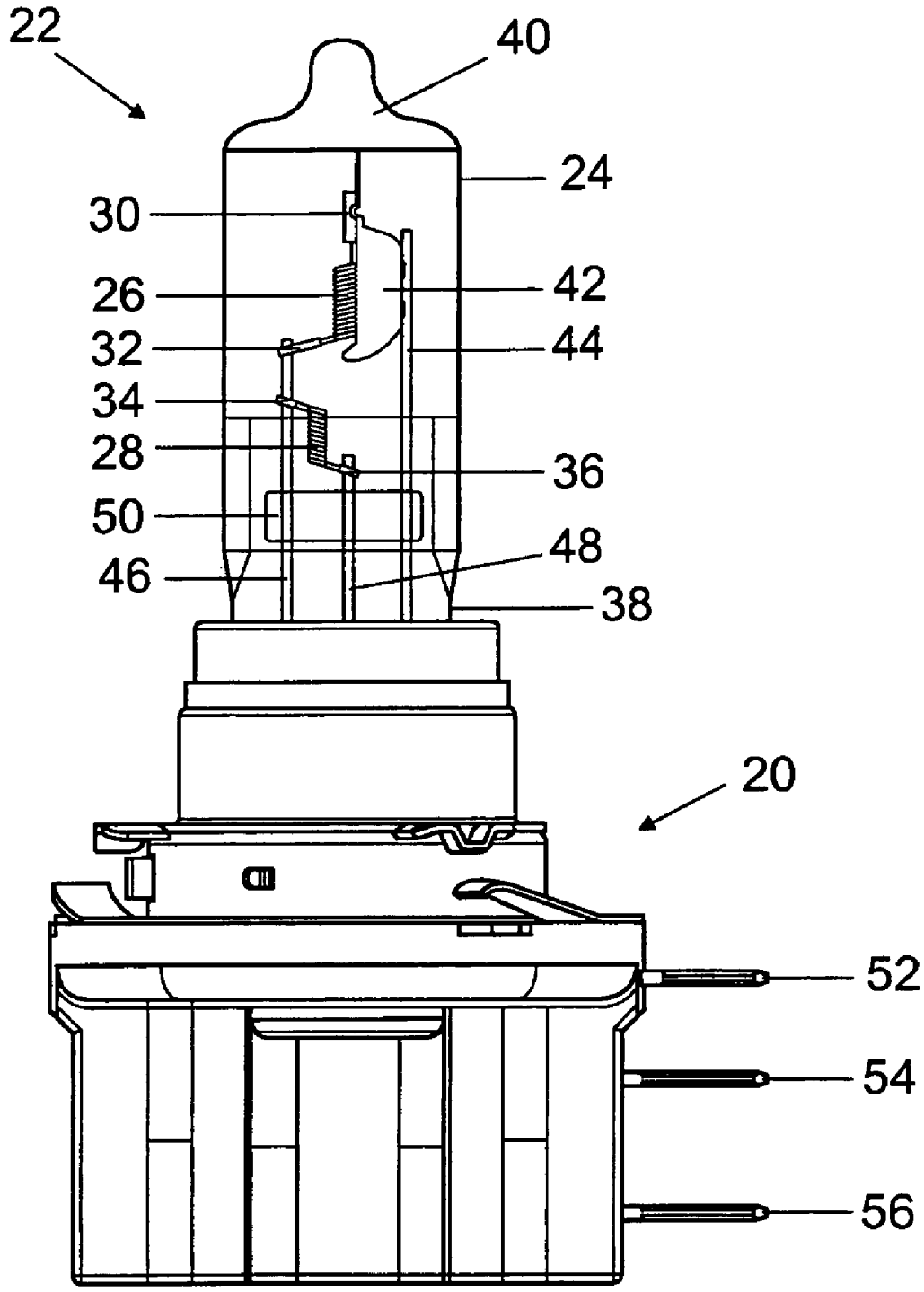
FIG. 2 shows a halogen incandescent lamp which has been provided with a lamp base for a vehicle headlamp, in which the present invention can be used.

FIG. 2 shows a halogen incandescent lamp 22 which has been provided with a lamp base 20 for a vehicle headlamp.

The halogen incandescent lamp 22 has a vitreous, substantially cylindrical lamp vessel 24, with two incandescent filaments 26, arranged in the interior of said lamp vessel, which incandescent filaments are aligned parallel to the lamp vessel axis and are used, for example, for producing an upper beam and a daytime running light or an upper beam and a lower beam. The incandescent filaments 26, 28 are in the form of tungsten wires with a single or double coil, for example.

The outgoing filament ends 30, 32 of the filament 26 and the outgoing filament ends 34, 36 of the filament 28 preferably have a molybdenum foil wound around them, which molybdenum foil acts as a welding aid when welding the outgoing filament ends to the power supply lines for the incandescent filament. A sealed-off end 38 of the lamp vessel 24 is anchored in the lamp base 20. The lamp vessel dome 40, which is remote from the lamp base 20, can be provided with an opaque coating 40. The incandescent filament 26 which is provided adjacent to the lamp vessel dome 40 is arranged adjacent to an anti-dazzle device 42, which is shaped from sheet molybdenum.

Figure 3:
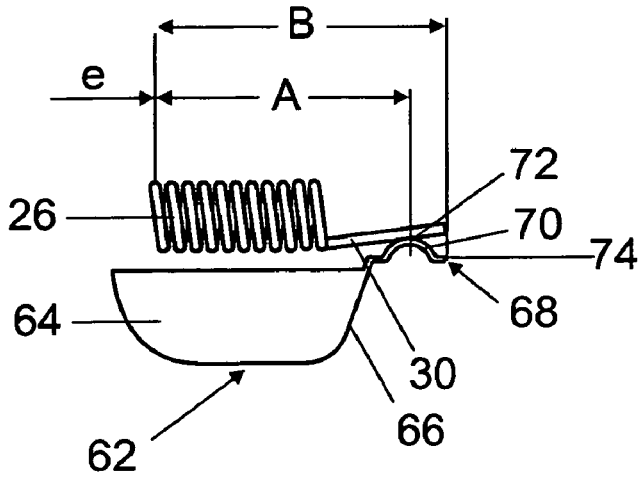
FIG. 3 shows an anti-dazzle device with a filament corresponding to the first exemplary embodiment.
Figure 4:
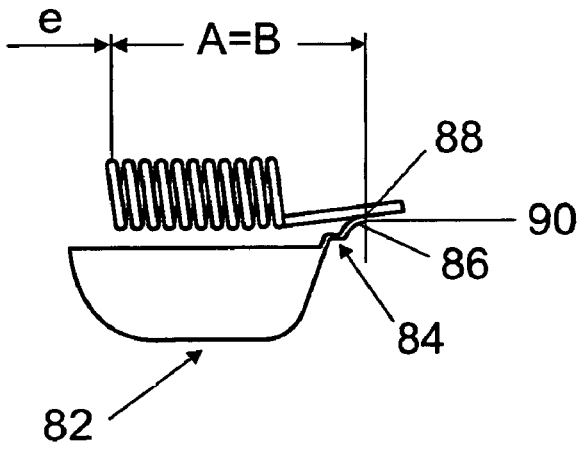
FIG. 4 shows an anti-dazzle device with a filament corresponding to the second exemplary embodiment.
Figure 5:
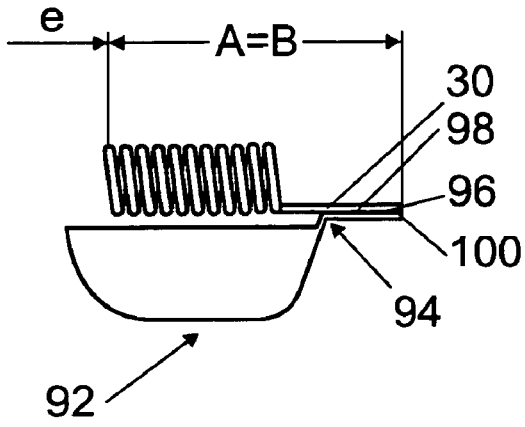
FIG. 5 shows an anti-dazzle device with a filament corresponding to the third exemplary embodiment.

The anti-dazzle device 42 and the incandescent filament 62 are emphasized by being enlarged in the illustrations in FIGS. 3, 4 and 5.

The outgoing filament end 30, which points towards the opaque coating 40, of the incandescent filament 26 is welded to the anti-dazzle device 42 in a peripheral region thereof, while the bottom of the trough-like anti-dazzle device 42 is welded to a power supply line 44. The outgoing filament end 32 of the incandescent filament 26 and the outgoing filament end 34 of the incandescent filament 28 are welded to a power supply line 46, while the outgoing filament end 36 of the incandescent filament 28 is welded to a power supply line 48.

The three power supply wires 44, 46, 48 are fixed via two quartz glass webs 50, which are fused with one another, with the result that the power supply lines 44, 46, 48 are arranged in one plane. When using hard glass, the power supply lines 44, 46, 48 pass through the sealed-off end 38 of the lamp vessel 24 and are in electrical contact with a contact lug 52, 54, 56 on the lamp base 20. Molybdenum foils are provided in the pinch seal in quartz glass. The three contact lugs 52, 54, 56 protrude laterally out of the lamp base 20 in relation to the mid-axis of the lamp vessel 24 and form the electrical terminals of the halogen lamp.

A design of the anti-dazzle device with the filaments, for example for an above described two-filament lamp, will be described below with reference to the first exemplary embodiment in FIG. 3. FIG. 3 shows the anti-dazzle device 62, which is illustrated merely schematically by the reference symbol 42 in FIG. 2, in a side view.

The anti-dazzle device 62 has a trough-like section 64, which can be stabilized, for example, by at least one rib (not illustrated in the figures). The welding lug 6 is connected to the trough-like section 64 via a connecting bevel 66 of the trough-like section 64 and has a transverse rib 70, via which the outgoing filament end 30 of the incandescent filament 26 can be welded to the anti-dazzle device 62. FIG. 3 does not illustrate the outgoing filament end 32, but merely the location at which the base-side outgoing filament end 32 emerges from the filament 26.

The distance between the welding point 72 of the outgoing filament end 30 with the transverse rib 70 and this point at which the base-side outgoing filament end 32 emerges from the filament 26 is denoted by A, while the distance between the end face 74 of the welding lug 68 and the point at which the base-side outgoing filament end 32 emerges from the filament 26 is denoted by B. The magnitude of the distance between the point at which the base-side outgoing filament end emerges from the filament and the base is denoted by the e dimension, corresponding to ECE R37. The magnitude of the distance A can be reduced to below 9.7 mm down to 5.2 mm from the 9.7 mm which is known for the H4 lamp depending on the requirements in terms of stamping, bending and deep-drawing. By shortening the end section of the welding lug 68, the magnitude of the distance B is reduced from the 11.9 mm known for the H4 lamp to below 11.9 mm down to 5.9 mm.

As a result, the anti-dazzle device 62 can be realized with a substantially smaller longitudinal dimension, with the result that, owing to the reduction in the quantity of material used for the cover, for example molybdenum, a noticeable reduction in costs can be achieved in the case of the anti-dazzle device with a filament corresponding to the present invention.

Since the outgoing filament end 30 which is also lit can be shortened, there is less parasitic light and lower bending moments can occur during welding, with the result that the position of the incandescent filament 26 can be determined more precisely than was previously the case.

Owing to the shorter outgoing filament end 30 and the reduced dimensions of the anti-dazzle device 62, the total resistance of this system is reduced and this results in lower transmission losses. In addition, a lower thermal capacity can be attributed to the reduced dimensions, with the result that the lamp starts up more quickly. The reduced dimensions furthermore bring about an increase in the resistance to vibrations.

FIG. 4 shows an anti-dazzle device 82 with a filament 26 corresponding to the second exemplary embodiment.

The anti-dazzle device 82 differs from the anti-dazzle device of the first exemplary embodiment by the welding lug 84. The welding lug 84 has a transverse rib 86, but, in contrast to the transverse rib 70 of the first exemplary embodiment, which has the form of a hollow cylinder halved at the longitudinal axis, has the shape of a hollow cylinder which has been quartered at the longitudinal axis, in cross section. As is also the case of the first exemplary embodiment, the welded joint 88 is formed by means of projection welding.

Since part of the longitudinal dimension of the welding lug from the first exemplary embodiment is no longer required in the second exemplary embodiment, there is a reduced dimension B from the end face 90 of the welding lug 84 to the point at which the base-side outgoing filament end 32 emerges from the filament 26, with the dimension B being equal to the dimension A since the welded joint 88 is located at the end face 50. FIG. 5 shows an anti-dazzle device 92 corresponding to the third exemplary embodiment, where the welding lug 94 has a flat surface 96. The outgoing filament end 30 therefore rests on the surface 94 and is welded thereto. In this case, in the same way as in the second exemplary embodiment shown in FIG. 4, it is preferred for the welded joint 98 to be arranged at the end face 100, with the result that the dimensions A and B are identical in the third exemplary embodiment as well.

With the present invention corresponding to one of the three exemplary embodiments, it is possible to achieve an anti-dazzle device which has been optimized in terms of costs and quality for an incandescent filament, which anti-dazzle device can be used for a reduced longitudinal dimension of the lamp bulb 24 even when the filament has the same distance as in the prior art.

The invention describes an anti-dazzle device with a filament for a two-filament lamp. In this case, the dimension between a point at which a base-side outgoing filament end emerges from the filament and the point on the outgoing filament end which is arranged opposite the base-side outgoing filament end and is welded to the anti-dazzle device is between approximately 5.2 mm and less than 9.7 mm, and the dimension between the point at which the base-side outgoing filament end emerges from the filament and the end face of the anti-dazzle device, which is adjacent to the outgoing filament end, at which the outgoing filament end is welded to the anti-dazzle device, is between approximately 5.9 mm and less than 11.9 mm.

The invention claimed is:

1. An anti-dazzle device (42) with a filament (26) for a two-filament lamp, the dimension between a point at which a base-side outgoing filament end (32) emerges from the filament (26) and the point on the outgoing filament end (30) which is arranged opposite the base-side outgoing filament end (30) and is welded to the anti-dazzle device (42) being between approximately 5.2 mm and less than 9.7 mm, and the dimension between the point at which the base-side outgoing filament end (32) emerges from the filament (26) and the end face (74) of the anti-dazzle device (42), which is adjacent to the outgoing filament end (30), at which the outgoing filament end is welded to the anti-dazzle device, being between approximately 5.9 mm and less than 11.9 mm.

2. The anti-dazzle device with a filament as claimed in claim 1, wherein the anti-dazzle device (42) is connected to the outgoing filament end (30) by means of projection welding.

3. The anti-dazzle device with a filament as claimed in claim 2, wherein the transverse rib (70) for the welding projection on the anti-dazzle device (42) for the projection welding has, in cross section, a form of a ring segment.

4. The anti-dazzle device with a filament as claimed in claim 1, wherein a planar face (96) of the anti-dazzle device is connected to the outgoing filament end (30).

5. The anti-dazzle device with a filament as claimed in one of the preceding claims, wherein the two-filament lamp is a two-filament vehicle headlamp.

6. The anti-dazzle device with a filament as claimed in claim 5, wherein the two-filament lamp is a two-filament halogen lamp.

7. A lamp with an anti-dazzle device with a filament as claimed in claim 1.

8. A headlamp with a lamp which has an anti-dazzle device with a filament as claimed in claim 5, in which a shield for the light/dark boundary is arranged outside of the lamp vessel (24) of the two-filament lamp and in the space delimited by the reflector.

9. The anti-dazzle device with a filament as claimed in claim 1, wherein the two-filament lamp is a two-filament halogen lamp.

10. The anti-dazzle device with a filament as claimed in claim 2, wherein the transverse rib (70) for the welding projection on the anti-dazzle device (42) for the projection welding has, in cross section, the form of a ring segment with an angle of 90°.

* * * * *